US008426713B1

(12) United States Patent
Sardo

(10) Patent No.: US 8,426,713 B1
(45) Date of Patent: Apr. 23, 2013

(54) TYPE PIANO

(76) Inventor: Philip Sardo, Sherman Oaks, CA (US)

( * ) Notice: Subject to any disclaimer, the term of this patent is extended or adjusted under 35 U.S.C. 154(b) by 0 days.

(21) Appl. No.: 13/246,423

(22) Filed: Sep. 27, 2011

(51) Int. Cl.
*G10C 3/12* (2006.01)

(52) U.S. Cl.
USPC ..... 84/423 R; 84/470 R; 84/483.2; 84/645

(58) Field of Classification Search ..... 84/423 R, 84/645, 470 R, 483.2
See application file for complete search history.

(56) References Cited

U.S. PATENT DOCUMENTS

| | | | | | |
|---|---|---|---|---|---|
| 1,560,020 | A | * | 11/1925 | Curley | 434/227 |
| 2,040,248 | A | * | 5/1936 | Dvorak et al. | 400/486 |
| 2,159,491 | A | * | 5/1939 | Rose | 84/404 |
| 2,432,527 | A | * | 12/1947 | Lang | 250/229 |
| 3,253,352 | A | * | 5/1966 | Kobler et al. | 434/229 |
| D225,276 | S | * | 11/1972 | Culbertson | D17/1 |
| 4,352,313 | A | * | 10/1982 | Ny | 84/425 |
| 4,655,117 | A | | 4/1987 | Roose | |
| 4,704,940 | A | * | 11/1987 | Cummings | 84/425 |
| 5,021,638 | A | * | 6/1991 | Nopper et al. | 235/145 R |
| 5,088,378 | A | * | 2/1992 | DeLaTorre | 84/470 R |
| D344,971 | S | * | 3/1994 | Roose | D17/2 |
| D367,858 | S | * | 3/1996 | Bertram et al. | D14/456 |
| D371,352 | S | * | 7/1996 | Bertram et al. | D14/395 |
| 5,646,648 | A | * | 7/1997 | Bertram | 345/168 |
| 5,971,635 | A | * | 10/1999 | Wise | 400/473 |
| 6,050,825 | A | * | 4/2000 | Nichol et al. | 434/227 |
| 6,063,994 | A | * | 5/2000 | Kew et al. | 84/600 |
| 6,066,795 | A | * | 5/2000 | Hara | 84/645 |
| 6,288,316 | B1 | * | 9/2001 | Fajardo | 84/483.2 |
| 6,388,182 | B1 | * | 5/2002 | Bermudez | 84/477 R |
| 6,444,888 | B1 | * | 9/2002 | VanDruff | 84/609 |
| D483,395 | S | * | 12/2003 | Horn | D17/1 |
| 6,752,631 | B2 | * | 6/2004 | Schwarzkopf | 434/227 |
| 6,880,998 | B2 | * | 4/2005 | Kraus et al. | 400/714 |
| D510,747 | S | | 10/2005 | Lin | |
| 6,977,334 | B2 | * | 12/2005 | Kimbrough | 84/483.1 |
| 7,674,965 | B2 | * | 3/2010 | Mataele | 84/483.2 |
| D668,708 | S | * | 10/2012 | Park et al. | D17/1 |
| 2004/0083877 | A1 | * | 5/2004 | Bubar | 84/423 R |
| 2009/0029329 | A1 | * | 1/2009 | Ackloo | 434/227 |
| 2009/0114078 | A1 | * | 5/2009 | Plamondon | 84/423 R |
| 2010/0089222 | A1 | * | 4/2010 | Rebstock | 84/483.2 |
| 2010/0180752 | A1 | * | 7/2010 | MacCoy | 84/483.2 |
| 2010/0242708 | A1 | * | 9/2010 | Rebstock | 84/483.2 |

* cited by examiner

*Primary Examiner* — David Warren
*Assistant Examiner* — Robert W Horn
(74) *Attorney, Agent, or Firm* — Goldstein Law Offices, P.C.

(57) ABSTRACT

A sound emitting system includes an abbreviated keyboard coupled to a speaker. The keyboard includes a plurality of rows stationed above a space bar row. The plurality of rows include labeled keys and unlabeled keys. The labeled keys correspond to five accidental notes and eight natural notes within a first octave. The labeled keys are labeled according to a keyboard layout. The speaker emits a note sound when one of the labeled keys is pressed.

21 Claims, 3 Drawing Sheets

300

TYPE PIANO

TECHNICAL FIELD

The present invention relates generally to keyboards. More particularly, the present invention relates to a type piano keyboard.

BACKGROUND

Conventional keyboard instruments, such as pianos, are generally difficult to master. In addition to basic musical talents, such instruments often require learned musical skills and an exceptional amount of manual dexterity and coordination. Consequently, musicians typically master such instruments only after much practice. In particular, mastery of such instruments is achieved often by individuals who take up the instrument and follow a rigorous practice schedule, especially at a young age. The difficulty associated with mastering such instruments often poses a chilling, impressing and intimidating effect on individuals who have not yet mastered the instrument, but nevertheless like to experience some degree of success in using such instruments to play pleasant sounding music.

The difficulty in adapting keyboard instruments to such individuals has been widely recognized. Hence, many modern electronic music keyboards are often complex machines, which produce a wide variety of sounds, rhythms and accompaniments so that pleasant sounding music may be more easily produced by a user. However, the user is still generally required to master the basic piano-style keyboard by associating musical notes, chords and the like with corresponding music keyboard keys, knowing precisely where each of the keys is located on the keyboard and pressing appropriate keys in real-time.

Various alternate musical notation schemes have been devised to help the user master the basic piano-style keyboard. However, such schemes are generally inadequate in helping the user learn precisely where each key is located. Consequently, various computer keyboard instruments have been devised. Such instruments often attempt to exploit common knowledge that is shared by a vast number of persons concerning the precise location of each of the keys on a computer keyboard. In theory, the computer keyboard knowledge, when optionally coupled with an alternate musical notation scheme, should go a long way toward helping the user to successfully play pleasant sounding music. In practice, however, a more intuitive approach is desired.

What is needed are better, more efficient ways of dealing with the foregoing issues or inconveniences.

BRIEF SUMMARY

An example embodiment of the present invention is a sound emitting system which includes an abbreviated keyboard coupled to a speaker. The keyboard includes a plurality of rows stationed above a space bar row. The plurality of rows include labeled keys and unlabeled keys. The labeled keys correspond to five accidental notes and eight natural notes within a first octave. The labeled keys are labeled according to a keyboard layout. The speaker emits a note sound when one of the labeled keys is pressed.

Another example embodiment of the present invention is a method of operating a sound emitting system which includes an abbreviated keyboard coupled to a speaker. The keyboard includes a plurality of rows stationed above a space bar row. The plurality of rows includes labeled keys and unlabeled keys. The labeled keys correspond to five accidental notes and eight natural notes within a first octave. The labeled keys are labeled according to a keyboard layout. The speaker emits a note sound when one of the labeled keys is pressed. The method includes observing alphanumeric characters. The method also includes pressing an alphanumerically labeled key corresponding to one of the observed alphanumeric characters. The method further includes hearing the note sound from the speaker.

Yet another example embodiment of the present invention is a method manufacturing a sound emitting system. The method includes coupling an abbreviated keyboard to a speaker. The keyboard includes a plurality of rows stationed above a space bar row. The plurality of rows includes labeled keys and unlabeled keys. The labeled keys correspond to five accidental notes and eight natural notes within a first octave. The labeled keys are labeled according to a keyboard layout. The speaker emits a note sound when one of the labeled keys is pressed.

BRIEF DESCRIPTION OF THE DRAWINGS

Objects, features and advantages of the present invention will become apparent to a skilled artisan in view of the following detailed description taken in combination with the attached drawings. In the drawings, like elements are depicted by like reference numerals. The drawings are briefly described as follows.

DETAILED DESCRIPTION OF THE PREFERRED EMBODIMENTS

The present invention now will be described more fully hereinafter with reference to the accompanying drawings, which show various example embodiments. However, the present invention may be embodied in many different forms and should not be construed as limited to the embodiments set forth herein. Rather, these embodiments are provided so that the present disclosure is thorough, complete and fully conveys the scope of the invention to those skilled in the art.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Example embodiments are described herein with reference to illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

U.S. patent application Ser. No. 13/225,828, filed on Sep. 6, 2011, is herein incorporated by reference in its entirety.

Figure 1:
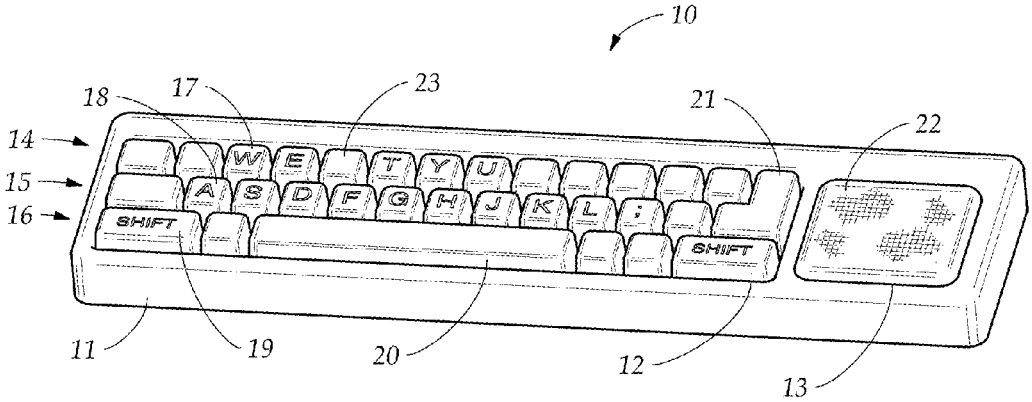
FIG. 1 shows a top view of an example embodiment of a sound emitting system according to the present invention.

FIG. 1 shows a top view of an example embodiment of a sound emitting system according to the present invention.

A sound emitting system 10 includes a housing 11 having a keyboard portion 12 coupled to a speaker portion 13. Alternatively, keyboard portion 12 and speaker portion are housed independently. Housing 11 can include plastic. Internally, housing 11 includes sound generating circuitry so sound emitting system 10 can be operated as a standalone device to play music. Sound emitting system 10 can be powered via batteries, solar power or via a cord.

Keyboard portion 12 includes rows of labeled and unlabeled keys. The keys are set in a first row 14, a second row 15 and a space bar row 16. Labeled keys can be arranged in any abbreviated or non-abbreviated keyboard layout, which includes mechanical, visual or functional layouts. As shown in FIG. 1, labeled keys are arranged in an abbreviated QWERTY keyboard layout. Some other types of keyboard layouts include DVORAK, AZERTY, JCUKEN, Braille or stenotype.

First row of keys 14 includes five alphanumerically labeled keys 17, which correspond to five sequential different accidental notes within a first octave as typically set in a keyboard instrument. The five keys are broken up into a left group and a right group. The left group includes keys W and E and the right group includes keys T, Y and U. Thus, W key corresponds to C-sharp and T key corresponds to F-sharp.

An unlabeled key 23 is stationed between the left group of keys and the right group of keys. To the left of the left group is a plurality of unlabeled keys and to the right of the right group is another plurality of unlabeled keys. Although unlabeled keys are not pressible, in an alternative example embodiment, unlabeled keys can be pressed and upon pressing, evoke a function, such as an error sound, or not evoke any function at all. In another example embodiment, more keys can be labeled in first row of keys 14 to correspond to a lower or a higher set of accidental notes. For example, in a QWERTY layout, a would be O key can correspond to C-sharp of a higher octave with respect to the first octave and a would be Tab key can correspond to a B-flat of a lower octave with respect to the first octave.

Second row of keys 15 includes ten alphanumerically labeled adjacent keys 18. Eight of keys 18, starting with A key, correspond to eight sequential different natural notes within the first octave, starting with C note corresponding to the A key. Hence, remaining two of keys 18 correspond to another octave higher than the first octave. The keys 18 are stationed between unlabeled keys. In another example embodiment, more keys can be labeled in second row of keys to correspond to a lower or a higher set of natural notes. For example, in a QWERTY layout, a would be Caps Lock key can correspond to a B-key of a lower octave and a would be Quote key can correspond to F-key.

Although keys of rows 14 and 15 correspond to a typical keyboard instrument layout, such correspondence can be reversed, such as accidentals correspond to row 15 and naturals correspond to row 14, or modified in any other way.

Space bar row of keys 16 includes a space bar 20 stationed between a plurality of modifier keys 19, such as shift keys. Although an amount of musical pitch modification can be customized, in an example embodiment, space bar 20 returns a musical pitch to a default pitch, such as the first octave, a right modifier key upwardly modifies the music pitch by one octave with respect to the first octave and a left modifier key downwardly modifies the musical pitch by one octave with respect to the first octave. In another example embodiment, pressing one of modifier keys from the plurality of modifier keys 19 upwardly modifies the musical pitch by one octave with respect to the first octave and space bar 20 downwardly modifies the musical pitch by one octave with respect to the first octave. Also, space bar row 16 includes unlabeled keys adjacent to space bar 20.

Although an enter key 21 is L-shaped, enter key 21 can be bar shaped. Enter key 21 can be a power-on and power-off key.

In an example mode of operation, an operator of sound emitting system 10 observes, such as on paper or on a display, a plurality of alphanumeric characters uniquely corresponding to a plurality of notes forming a musical tune. The observed characters essentially form sheet music, as a list of characters. The characters can be arranged in a form of a sentence or a paragraph, such as "We ate Just figs" or "KK jj fAd". The alphanumeric characters correspond to the alphanumerically labeled keys from rows 14 or 15 to form sheet music. The operator presses a key from row 14 or 15 corresponding to one of the alphanumeric characters and hears a note sound or a chord sound corresponding to the pressed key. Thus, a musical tune can be played by someone familiar with a QWERTY keyboard and unfamiliar with a keyboard instrument. This mode of operation can train the operator to associate note sounds with finger positions as in the keyboard instrument so the operator can later transition to playing an actual piano or another keyboard instrument.

Figure 2:
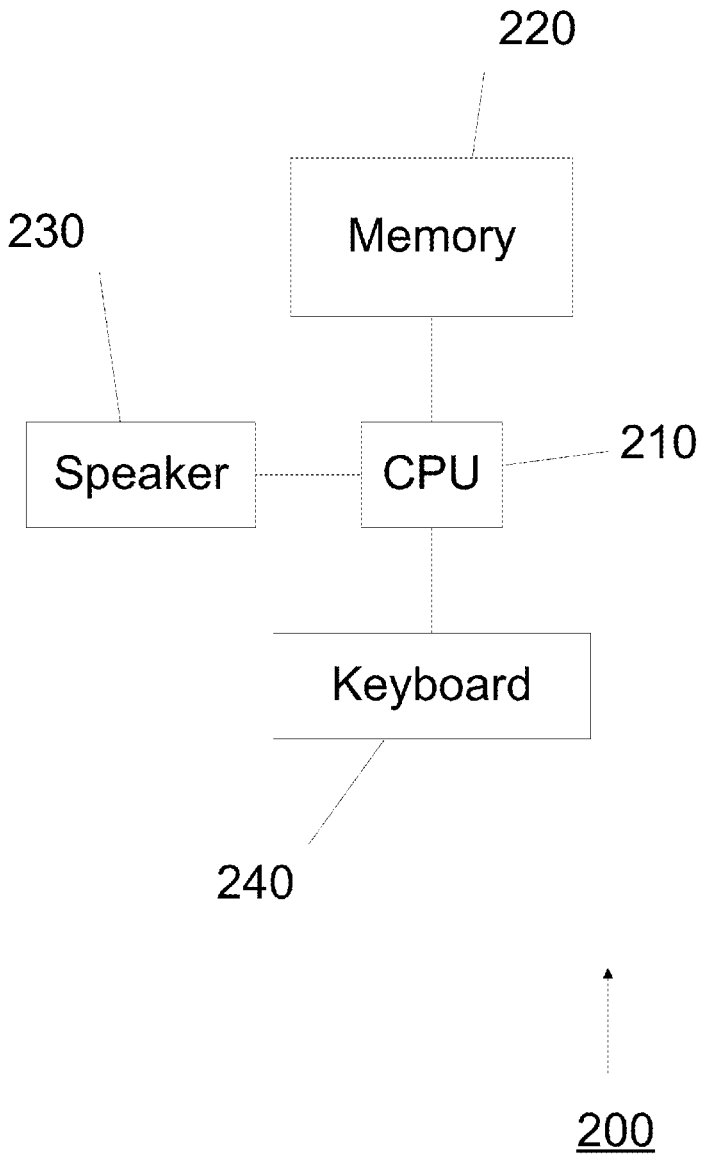
FIG. 2 shows a schematic diagram of an example embodiment of a sound emitting system according to the present invention.

FIG. 2 shows a schematic diagram of an example embodiment of a sound emitting system according to the present invention.

A sound emitting system 200 includes a central processing unit (CPU) 210 coupled to a memory 220, a speaker 230 and a keyboard 240, such as described in FIG. 1. Memory 220 stores at least thirteen distinct sounds corresponding to note sounds of five accidental notes and eight natural notes within one octave, such as the first octave described in FIG. 1. At least thirteen labeled keys on keyboard 240 correspond to the thirteen distinct sounds.

In an example mode of operation, an operator presses a key on keyboard 240. Upon pressing, keyboard 240 sends a signal to CPU 210 to issue a command to emit a note sound corresponding to the pressed key. CPU 210 retrieves the note sound from memory 220 and sends the note sound to speaker 230, which emits the note sound.

Figure 3:
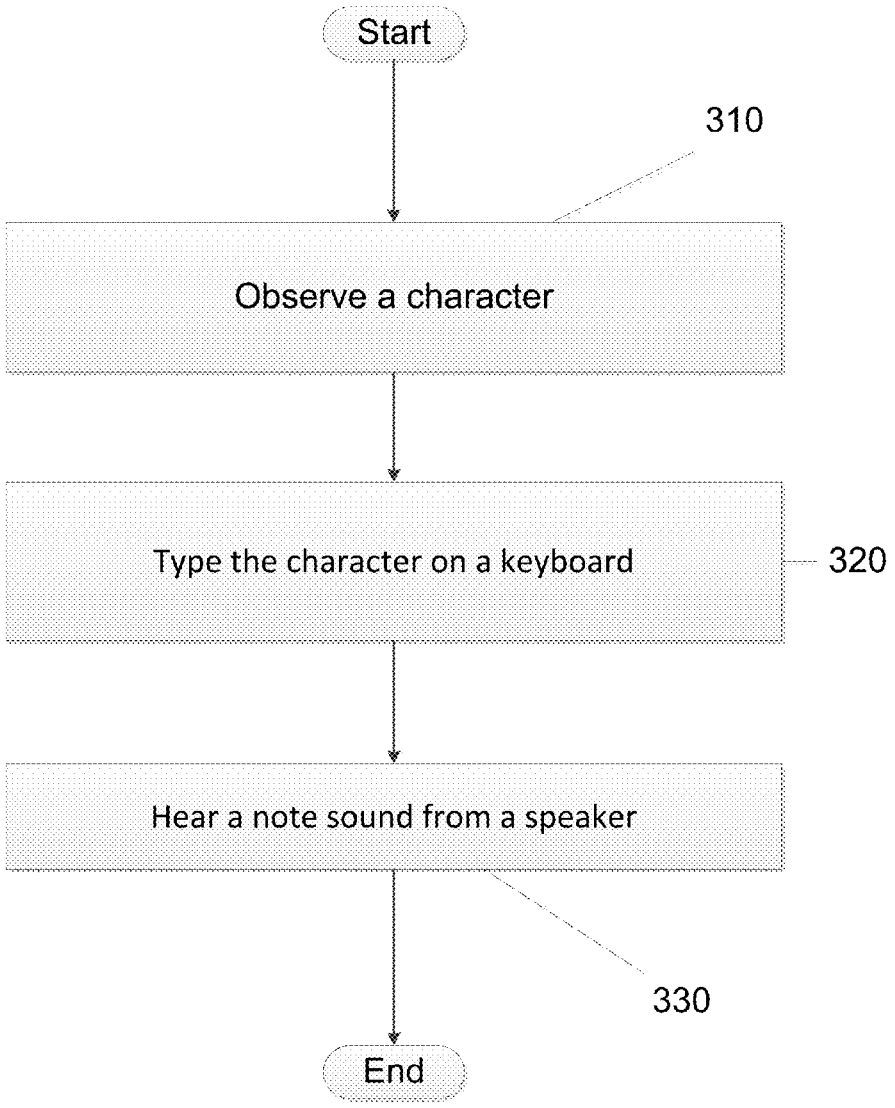
FIG. 3 shows a flowchart of an example embodiment of a method of operating a sound emitting system according to the present invention.

FIG. 3 shows a flowchart of an example embodiment of a method of operating a sound emitting system according to the present invention. A process 300 includes blocks 310-330 and can be performed via the sound emitting system, as described above.

Block 310 includes observing a character. The character corresponds to a note within an octave. The character can displayed as a lower case character or an upper case character or a number.

Block 320 includes typing the character on a keyboard. If the character is displayed in the upper case, then the user can press a modifier key and the corresponding character key to modify the case of the character.

Block 330 includes hearing a note sound from a speaker. The note sound corresponds to at least one of thirteen sounds including five different accidental notes within the octave and eight different natural notes within the octave. Note sounds from other octaves can also be heard. Thus, an operator can observe and type words, sentences or paragraphs and hear music tunes.

In conclusion, herein is presented a sound emitting system. Embodiments of the present invention are illustrated by example in the drawing figures and throughout the written description. A skilled artisan understands that numerous variations are possible, while adhering to the inventive concept without departing from the broader spirit and scope of the invention as set forth in the claims that follow. Such variations are contemplated as being a part of the present invention.

What is claimed is:

1. A device comprising:

a housing including a keyboard portion and a speaker portion, the keyboard portion including a top key row, a middle key row and a bottom key row immediately adjacent to each other, the top row including five keys arranged as five accidental notes within one octave and alphabetically labeled according to an abbreviated keyboard layout, the middle row including eight keys arranged as eight natural notes within the one octave and alphabetically labeled according to the layout, the bottom row including a space bar key between modifier keys, the speaker portion including a speaker operative to emit note sounds.

2. The device of claim 1, wherein at least one of the top row, the middle row and the bottom row includes at least one unlabeled key.

3. The device of claim 1, wherein at least one of the modifier keys facilitates shifting of a musical pitch.

4. The device of claim 1, wherein the space bar key facilitates shifting of a musical pitch.

5. The device of claim 1, wherein at least one of the modifier keys upwardly shifts a musical pitch by an octave.

6. The device of claim 1, wherein at least one of the modifier keys downwardly shifts a musical pitch by an octave.

7. The device of claim 1, wherein the space bar key shifts a musical pitch from a non-default pitch to a default pitch.

8. The device of claim 1, wherein at least one of the top row, the middle row and the bottom row includes unlabeled keys, at least one of the unlabeled keys is not pressible.

9. The device of claim 1, wherein at least one of the top row, the middle row and the bottom row includes at least one unlabeled key, the unlabeled key is pressible.

10. The device of claim 1, wherein the top row includes a labeled key corresponding to an accidental note of another octave different from the one octave.

11. The device of claim 1, wherein the middle row includes a labeled key corresponding to a natural note of another octave different from the one octave.

12. The device of claim 1, further comprising an enter key.

13. The device of claim 12, wherein the enter key is above one of the modifier keys.

14. The device of claim 12, wherein the enter key is L-shaped, the top row and the middle row include the enter key, the one of the modifier keys is immediately adjacent to the enter key.

15. The device of claim 14, wherein the enter key is peripherally positioned.

16. The device of claim 1, wherein the housing includes a side operative to face a user, the side includes the keyboard portion and the speaker portion.

17. The device of claim 1, wherein the speaker receives power from at least one of solar power, a battery and a cord.

18. The device of claim 1, wherein the layout is a QWERTY layout, the housing containing a processor operably coupled to the speaker and a memory operably coupled to the processor, the memory storing sound information corresponding to the five keys and the eight keys.

19. The device of claim 1, wherein the layout is selected from a group consisting of a QWERTY layout, a DVORAK layout, an AZERTY layout, a JCUKEN layout, a Braille layout and a stenotype layout.

20. A method comprising:

providing a housing having a keyboard portion and a speaker portion;

forming a top key row, a middle key row and a bottom key row in the keyboard portion, the top row, the middle row and the bottom row immediately adjacent to each other, the top row including five keys arranged as five accidental notes within one octave and alphabetically labeled according to an abbreviated keyboard layout, the middle row including eight keys arranged as eight natural notes within the one octave and alphabetically labeled according to the layout, the bottom row including a space bar key between modifier keys; and installing a speaker into the speaker portion, the speaker operative to emit note sounds.

21. A method comprising:

observing an alphabetic character;

pressing a key on a device, the key corresponding to the observed character, the device including a housing including a keyboard portion and a speaker portion, the keyboard portion including a top key row, a middle key row and a bottom key row immediately adjacent to each other, the top row including five keys arranged as five accidental notes within one octave and alphabetically labeled according to an abbreviated keyboard layout, the middle row including eight keys arranged as eight natural notes within the one octave and alphabetically labeled according to the layout, the bottom row including a space bar key between modifier keys, the speaker portion including a speaker operative to emit note sounds; and hearing a note sound from the speaker.

* * * * *